US008895823B2

(12) United States Patent
Musel

(10) Patent No.: US 8,895,823 B2
(45) Date of Patent: Nov. 25, 2014

(54) SUSTAIN BLOCK FOR STRINGED INSTRUMENTS

(71) Applicant: Walter Musel, Chelsea, IA (US)

(72) Inventor: Walter Musel, Chelsea, IA (US)

( * ) Notice: Subject to any disclaimer, the term of this patent is extended or adjusted under 35 U.S.C. 154(b) by 290 days.

(21) Appl. No.: 13/622,899

(22) Filed: Sep. 19, 2012

(65) Prior Publication Data

US 2013/0074674 A1 Mar. 28, 2013

Related U.S. Application Data

(60) Provisional application No. 61/538,275, filed on Sep. 23, 2011.

(51) Int. Cl.

| | |
|---|---|
| ***G10D 3/00*** | (2006.01) |
| ***G10D 3/02*** | (2006.01) |
| ***G10D 3/12*** | (2006.01) |

(52) U.S. Cl.

CPC ... *G10D 3/02* (2013.01); *G10D 3/12* (2013.01)
USPC ..... 84/299

(58) Field of Classification Search

USPC ..... 84/267, 290, 294
See application file for complete search history.

(56) References Cited

U.S. PATENT DOCUMENTS

| | | | |
|---|---|---|---|
| 4,681,010 | A | 7/1987 | Wilkinson |
| 4,967,631 | A | 11/1990 | Rose |
| 6,084,166 | A | 7/2000 | Lee |
| 7,189,908 | B2 | 3/2007 | Lavineway |
| 7,838,752 | B2 | 11/2010 | LaMarra |
| 2002/0092404 | A1 | 7/2002 | Naimish |
| 2011/0252941 | A1 | 10/2011 | Prins |

*Primary Examiner* — Kimberly Lockett
(74) *Attorney, Agent, or Firm* — Mark David Torche; Patwrite LLC

(57) ABSTRACT

An improved sustain block of stringed instruments has a string path defined within a sustain block that has a bottom opening with a string ball end nest to anchor a musical instrument string within and a top opening directly connected to a bore portion disposed within an upper portion of the sustain block and a channel portion connecting the bore portion to the bottom opening. The string path defines a geometric curve that allows the musical instrument string to make contact with the sustain block along almost the entirety of the path thereby allowing better transfer of the musical qualities of the vibrating string to be transferred to the musical instrument. The shape of the string path is selected to ensure maximum contact.

11 Claims, 10 Drawing Sheets

SUSTAIN BLOCK FOR STRINGED INSTRUMENTS

CROSS REFERENCE TO RELATED APPLICATIONS

This application claims priority and herein incorporates by reference U.S. provisional patent application 61/538,275, filed Sep. 23, 2011.

BACKGROUND OF THE INVENTION

One of the distinctive qualities of all musical instruments is known as sustain. Sustain refers to the time period over which the musical sound can still be heard. Although there are times when you would like to minimize sustain, it is often a desirable quality of the musical instrument. Stringed instruments in general and guitars in particular have a fairly long sustain. In guitars, many factors affect the sustain including the type of material the guitar is made from, the kind of guitar, such as acoustic, semi-acoustic or electric, the shape, density of the strings, etc. just to name a few of the factors. Sound characteristics such as tone and brightness are also affected by the sustain of the guitar. There have been many inventions relating to increasing the sustain of musical instruments.

Another important quality of all musical instruments is known as tone. Tone is determined by the by the quality and quantity of overtones or partials present in the sounds that the instrument produces.

There is a need for a sustain block that enhances the quality of the sound of a stringed instrument without increasing the cost of manufacturing that can be used with new stringed instruments as well as being able to be retro-fitted with existing instruments.

SUMMARY OF THE INVENTION

An improved sustain block of stringed instruments has a string path defined within a sustain block that has a bottom opening with a string ball end nest to anchor a musical instrument string within and a top opening directly connected to a bore portion disposed within an upper portion of the sustain block and a channel portion connecting the bore portion to the bottom opening. The string path defines a geometric curve that allows the musical instrument string to make contact with the sustain block along almost the entirety of the path thereby allowing better transfer of the musical qualities of the vibrating string to be transferred to the musical instrument. The shape of the string path is selected to ensure maximum contact.

Other features and advantages of the instant invention will become apparent from the following description of the invention which refers to the accompanying drawings.

DETAILED DESCRIPTION OF THE INVENTION

Figure 1:
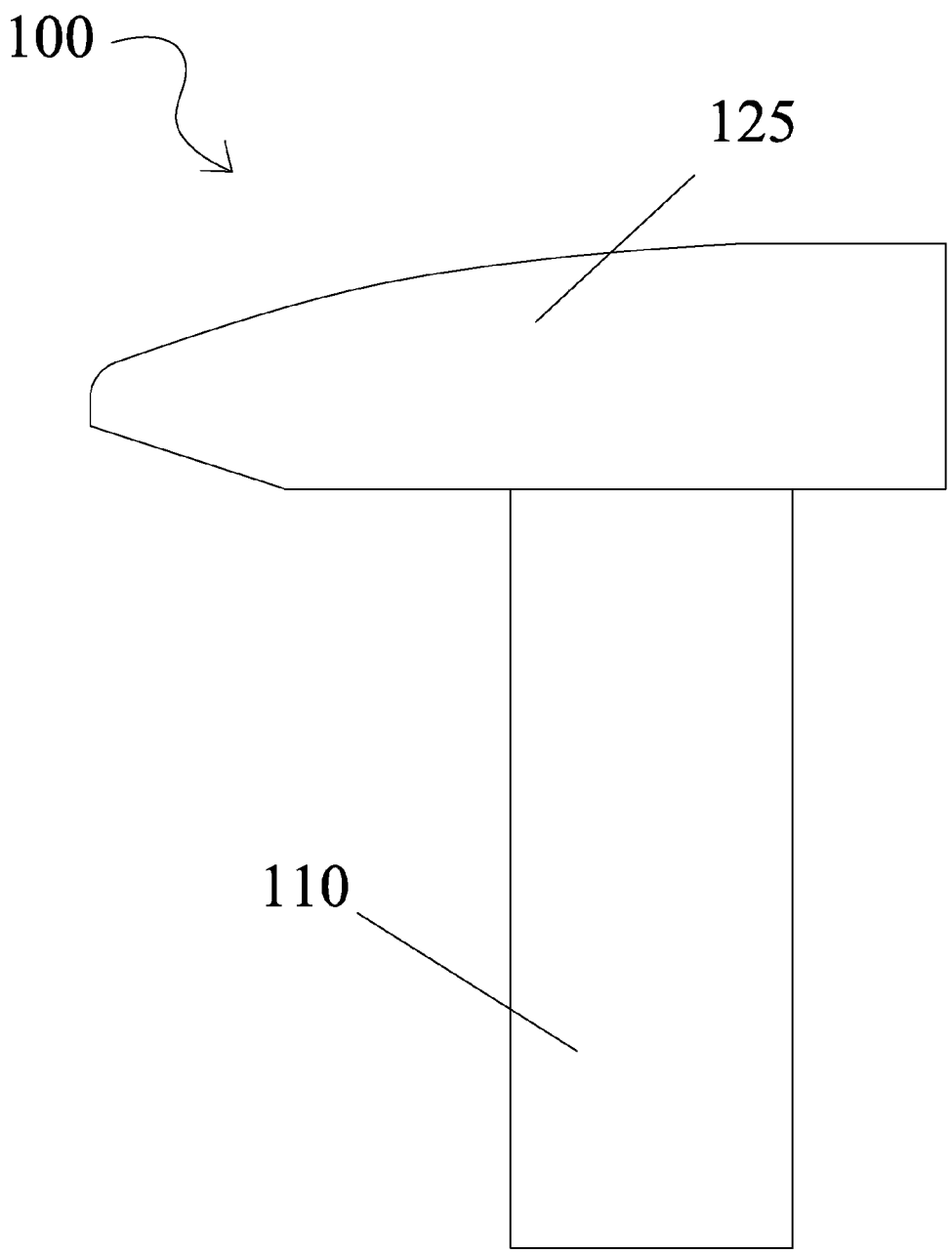
FIG. 1 is a side view of an improved sustain block for stringed instruments according to an embodiment of the present invention.
Figure 2:
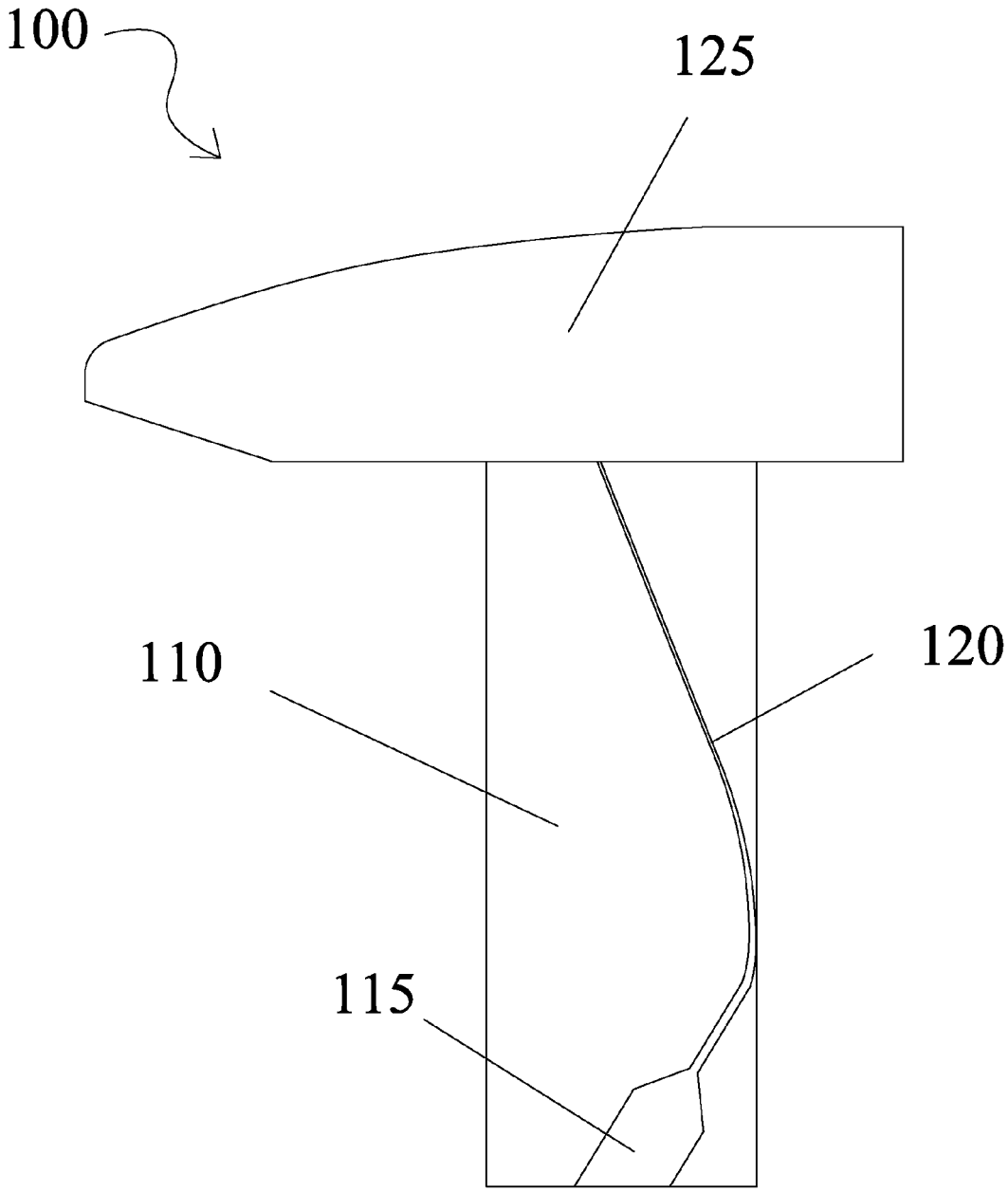
FIG. 2 is a cut-away side view of the improved sustain block for stringed instruments shown in FIG. 1.
Figure 3:
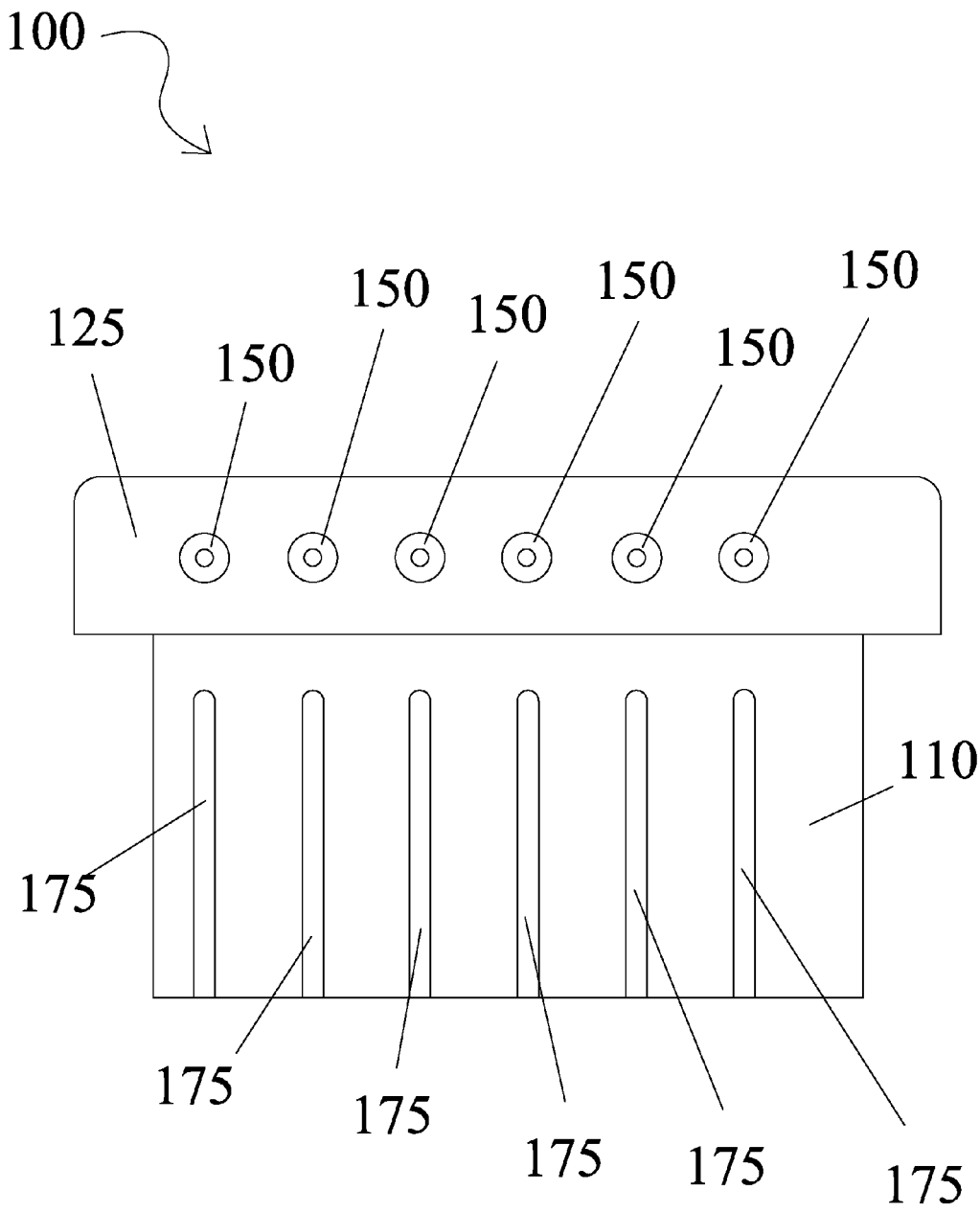
FIG. 3 is a back view of the improved sustain block for stringed instruments shown in FIG. 1.
Figure 4:
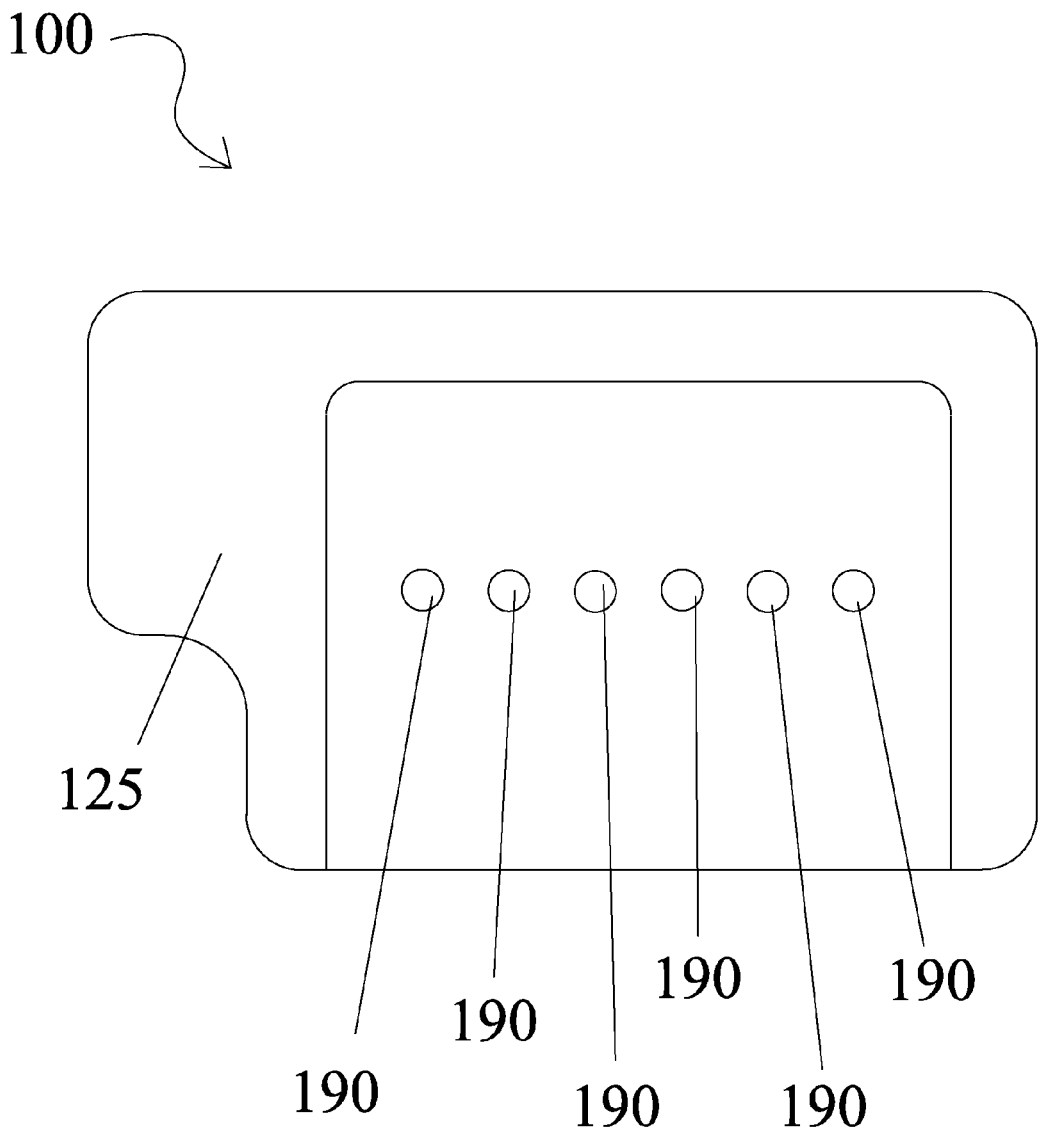
FIG. 4 is a top view of the improved sustain block for stringed instruments shown in FIG. 1.

In the following detailed description of the invention, reference is made to the drawings in which reference numerals refer to like elements, and which are intended to show by way of illustration specific embodiments in which the invention may be practiced. It is understood that other embodiments may be utilized and that structural changes may be made without departing from the scope and spirit of the invention.

Referring to FIGS. 1-4, an improved sustain block for stringed instruments 100 is shown having a sustain block portion 110 with a saddle plate 125 on an upper portion. Sustain block portion 110 has a plurality of curved string paths 120 and access channels 175 which are shaped to allow a string (not shown) to make contact all along curved string path 120 without introducing pinch points or dead spots as occurs in the prior art (not shown). At the bottom of each curved string path 120, a string ball end nest 115 is used to hold the string (not shown) within curved string path 120 and secure it so that it can be tensioned.

Saddle plate 125 has a plurality of saddle intonation adjustment screw holes 150 that are used to allow a user to adjust the intonation of the instrument as is known in the art. A plurality of coinciding string holes 190 are provided so that the strings can exit sustain block portion 110. Because of the unique shape of curved string path 120, more frequencies along with a full spectrum of harmonics are transferred to sustain block allowing for a fuller sound than is possible in the prior art. This enhances both the tone and sustain of the sound produced.

Figure 5:
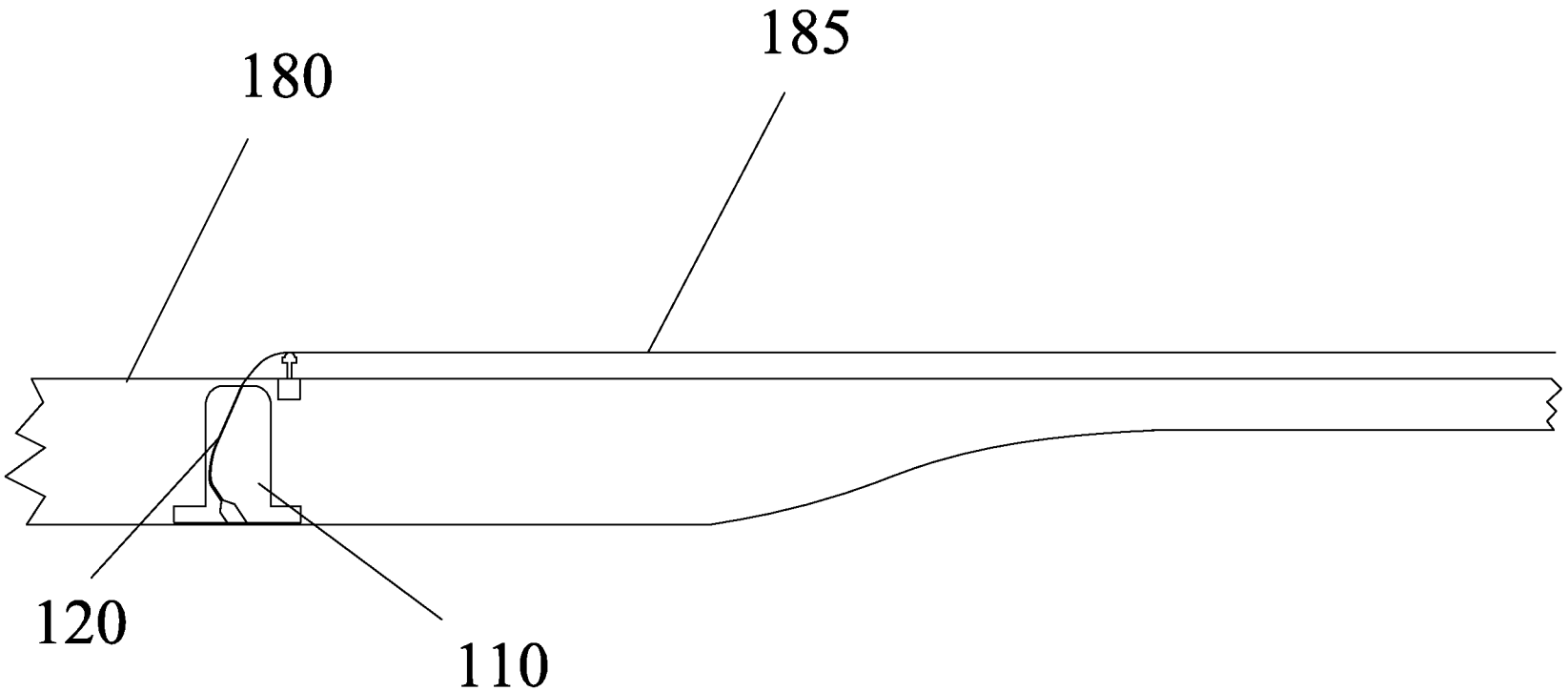
FIG. 5 is a cut-away side view of an improved sustain block for stringed instruments shown installed in a guitar according to an embodiment of the invention.
Figure 6:
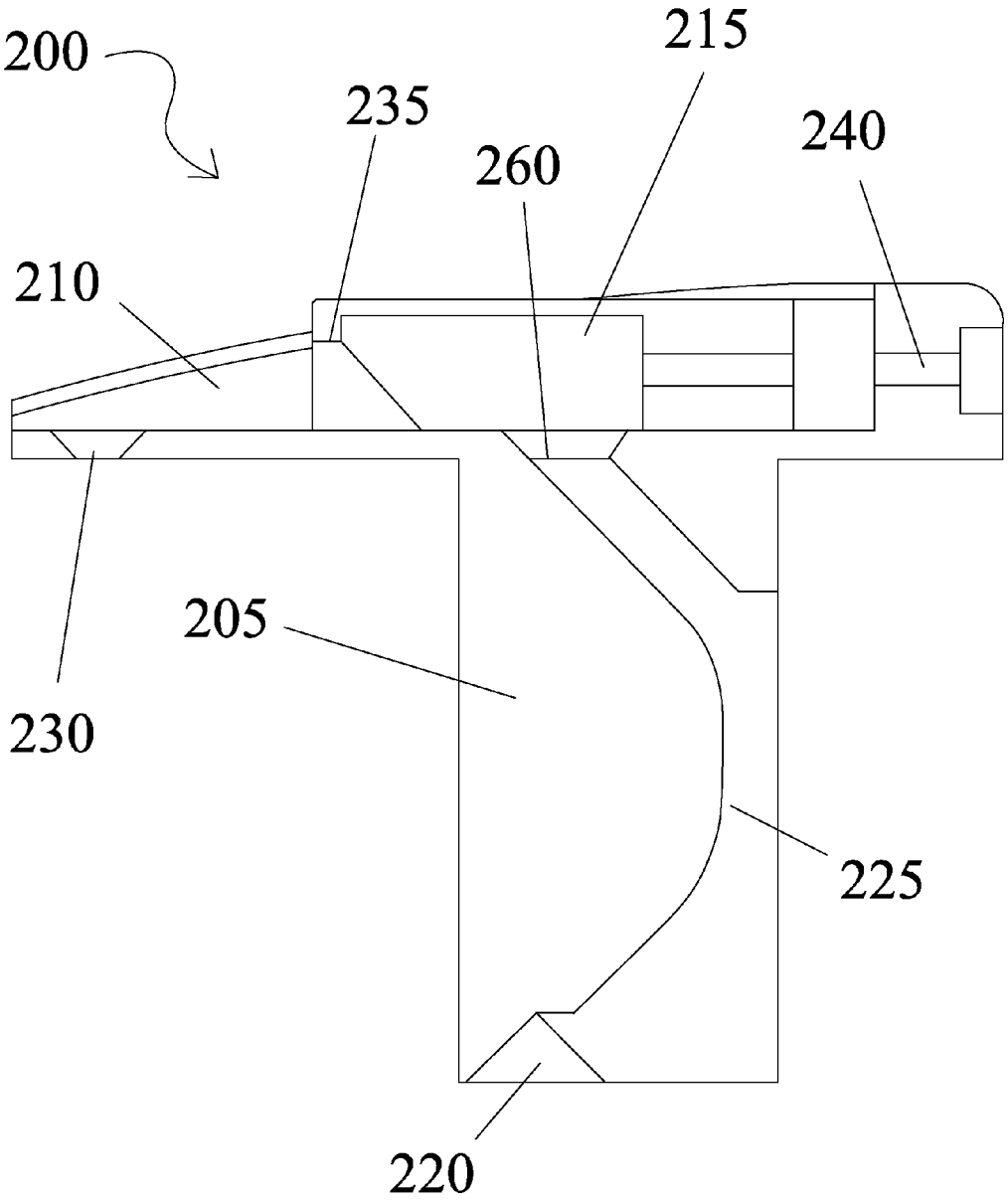
FIG. 6 is a cut-away side view of an improved sustain block for stringed instruments according to an embodiment of the invention.
Figure 7:
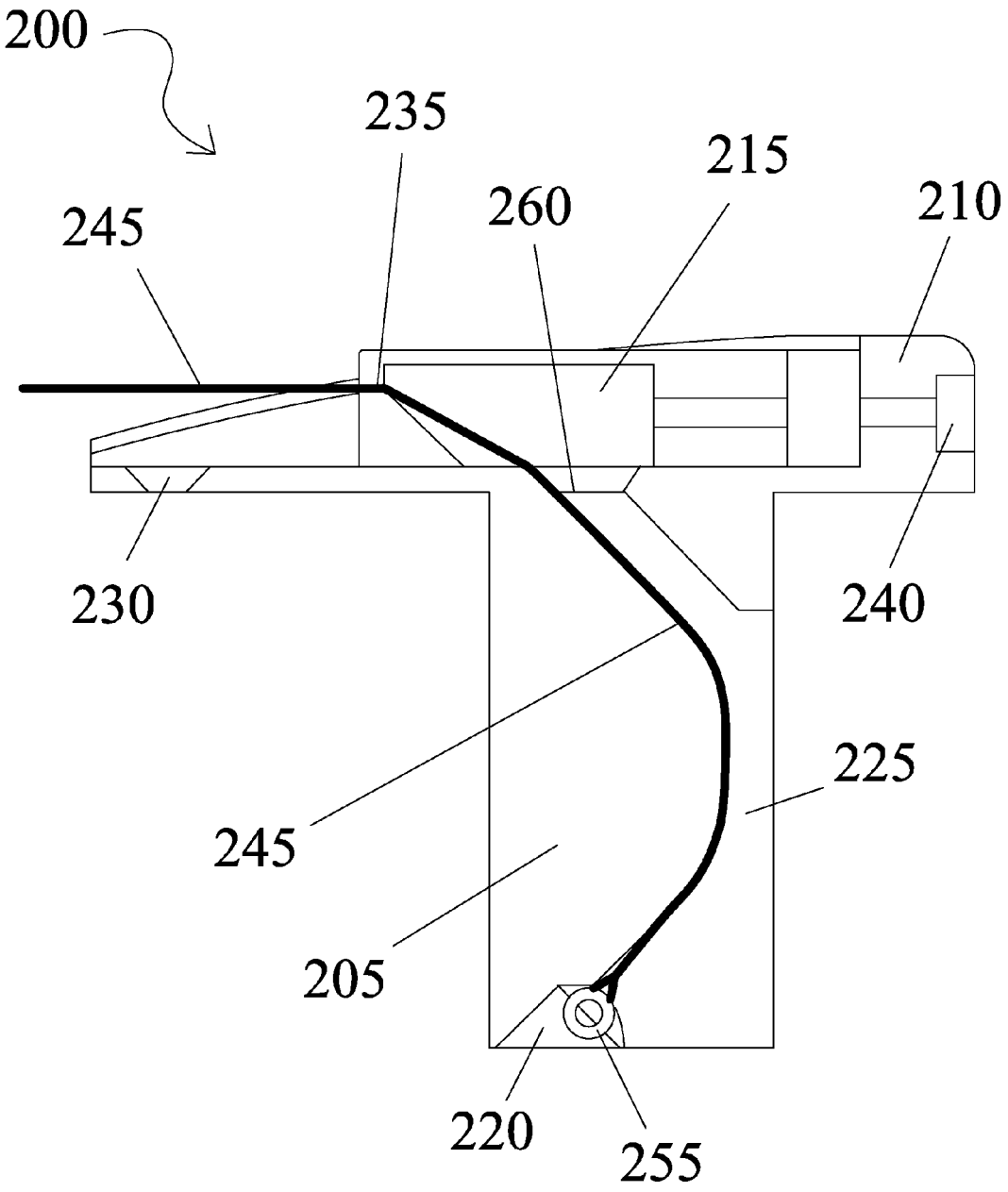
FIG. 7 is a cut-away side view of the improved sustain block for stringed instruments shown in FIG. 6 with a string shown.
Figure 8:
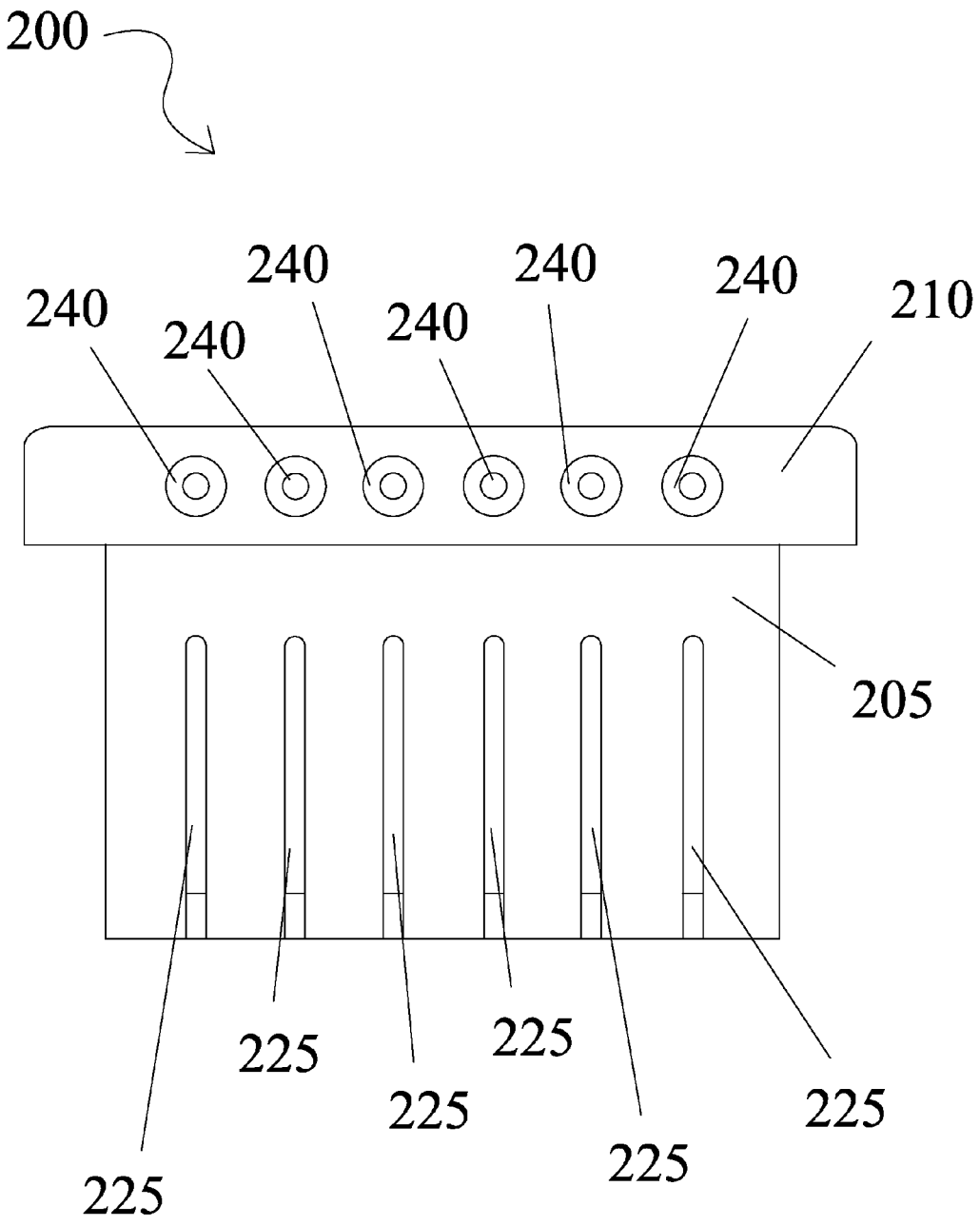
FIG. 8 is a rear view of the improved sustain block for stringed instruments shown in FIG. 6.
Figure 9:
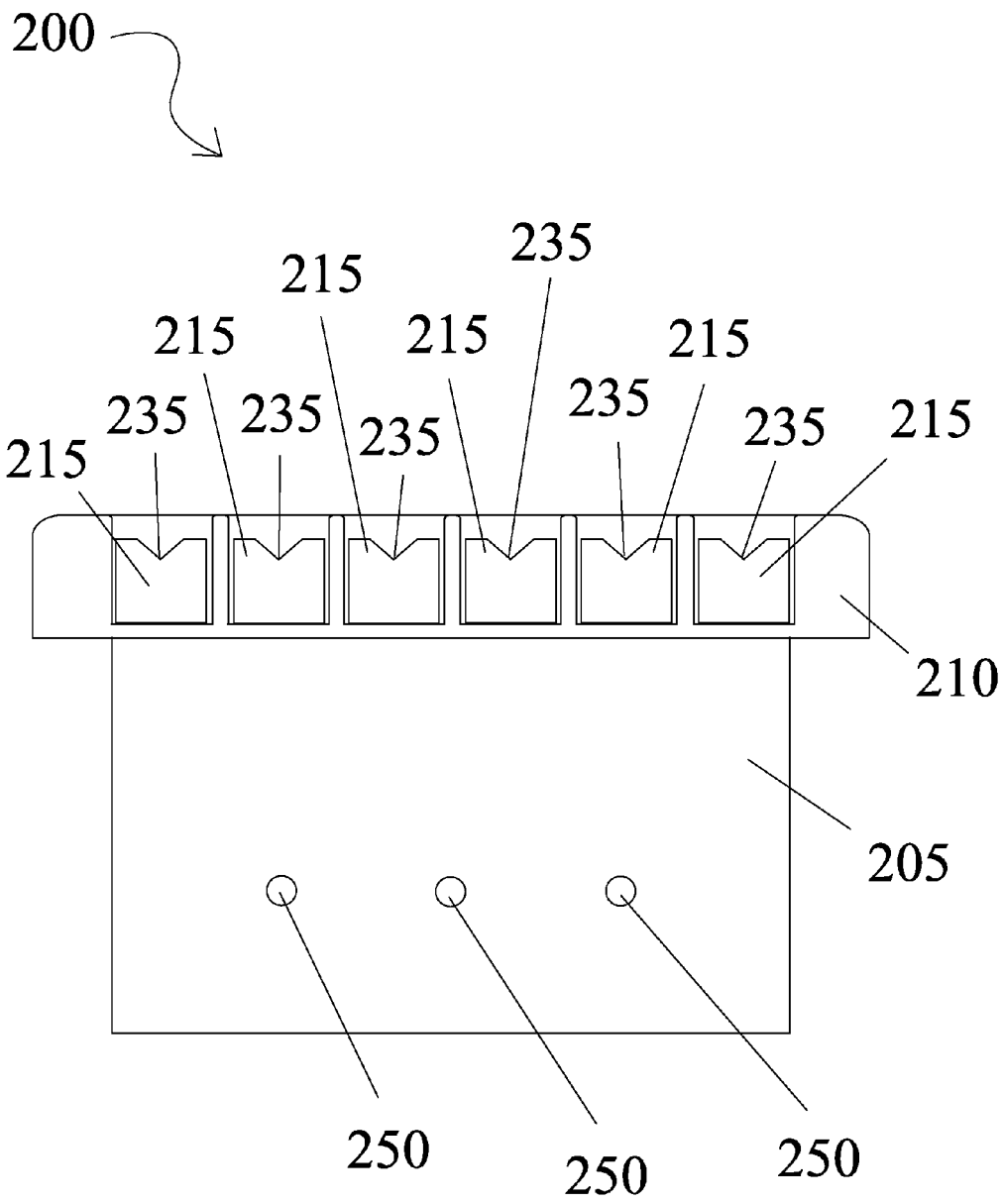
FIG. 9 is a front view of the improved sustain block for stringed instruments shown in FIG. 6.
Figure 10:
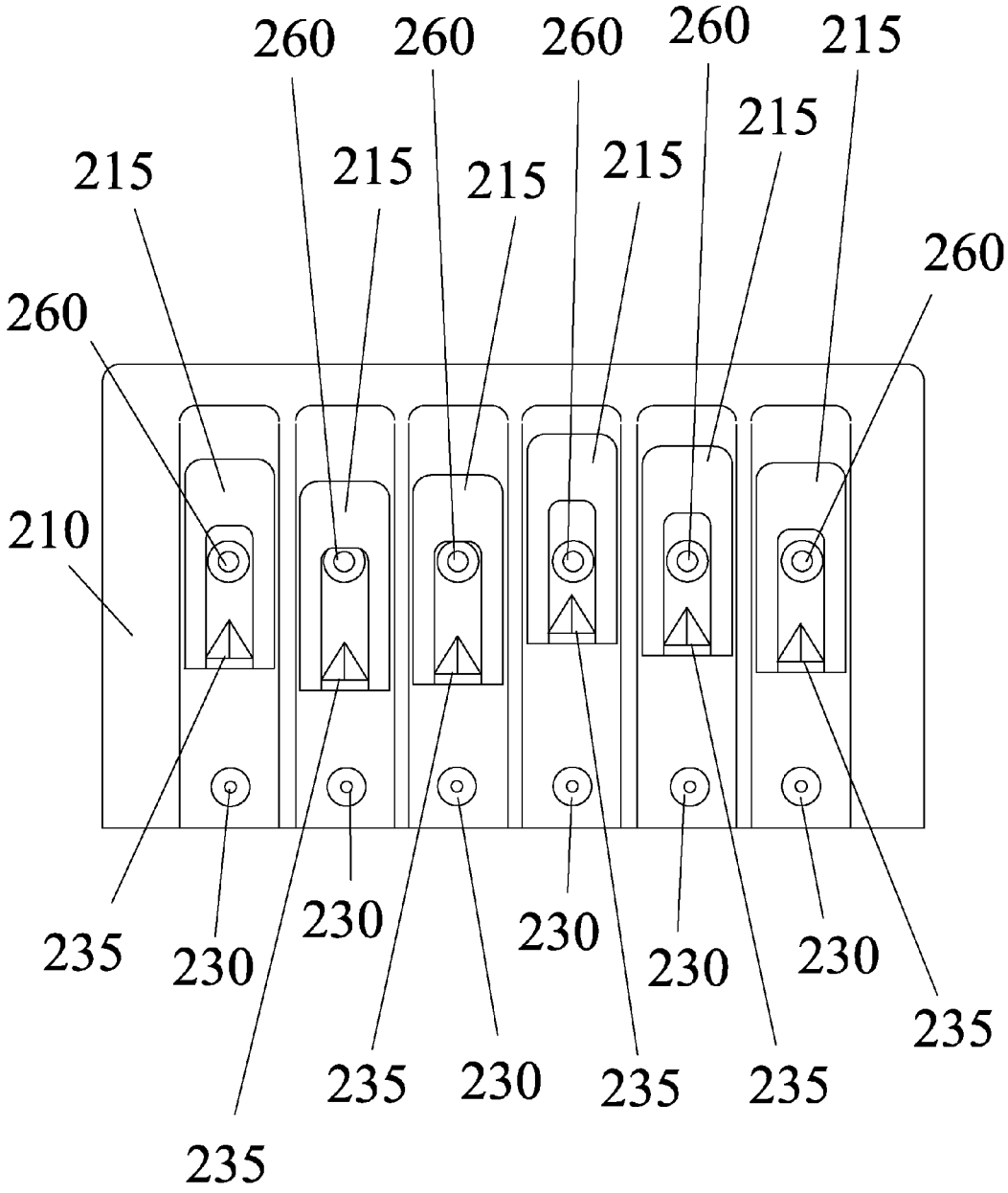
FIG. 10 is a top view of the improved sustain block for stringed instruments shown in FIG. 6.

Now referring to FIG. 5, a stringed instrument 180 such as a guitar, is shown with an improved sustain block for stringed instruments mounted within instrument 180. A string 185 is shown curving within curved string path 120. Although shown attached to the bottom of instrument 180, the instant invention may be attached in many different configurations such as with tremolo bridge, FLOYD ROSE type sustain block among others as long as the critical curved path shape is used. Additionally, brass, aluminum, tungsten and other dense material may be used as long as it has enough mass to provide the desired sustain and tone and can be machined to provide the required curved path.

Referring to FIGS. 6-10, an improved sustain block for stringed instruments 200 is shown having a sustain block portion 205 with a specially formed string path channel 225 within sustain block portion. The shape of string path channel 225 is selected to ensure that a string 245 makes contact with sustain block 205 as string 245 is tensioned. Because string 245 makes contact all along string path channel 225, more of the acoustic energy is transferred to sustain block 205 therefore increasing desirable acoustic properties of stringed instruments using the instant invention.

String 245 has a ball end 255 that fits within a string ball end nest 220 to secure string 245. String 245 fits over an adjustable saddle 215 and through a string groove 235 as it exits sustain block 205 through string opening 260. Adjustable saddle is adjusted using an adjustment screw (not shown) that fits through saddle adjustment screw hole 240. The specific curve of string path channel 225 may be a selected geometric curve such as a catenary, parabolic or other curve selected to maximize contact as discussed above. In general, string paths defined by prior art have places where the string is not really in contact with the sustain block since they are merely straight bore holes and the string makes contact only at points along the path. The instant invention greatly enhances the transfer of the musical qualities present in a vibrating string to the sustain block by providing a string path that has the string maintaining contact along almost the entire string path disposed within the sustain block.

Improved sustain block for stringed instruments 200 is secured to a stringed instrument (not shown) using screws (not shown) that fit within mounting holes 230 for a tremolo embodiment. In a non-tremolo embodiment mounting holes 230 and 250 are used to ensure stability. Of course other securing methods would be acceptable such as, but not limited to glue, adhesives, a combination of glue and mechanical fasteners, rivets, pegs, etc. as long as improved sustain block 200 is affixed to the body of the musical stringed instrument such as a guitar, violin, etc. in a manner consistent with the tremolo or non-tremolo embodiment.

Although the instant invention has been described in relation to particular embodiments thereof, many other variations and modifications and other uses will become apparent to those skilled in the art.

What is claimed is:

1. An improved sustain block for stringed instruments comprises:

a sustain block portion;

a saddle plate disposed on a top edge of said sustain block portion;

said sustain block portion having at least one curved string path channel disposed within;

said curved string path channel having a curve arc selected to maximize contact between a string and said curved string path channel when said string is tensioned therein;

said curved string path channel extending in a vertical orientation within said sustain block;

a string securing nest disposed at a bottom of said sustain block and adapted to create a bottom opening of said string path channel; and an upper string opening disposed on an upper portion of said curved string path channel.

2. The improved sustain block for stringed instruments according to claim 1 further comprising at least one adjustable saddle moveably disposed on an upper surface of said saddle plate.

3. The improved sustain block for stringed instruments according to claim 2 wherein said saddle plate has at least one saddle plate string opening coinciding with said upper string opening wherein said string is secured within said string securing nest, passing through said string path channel, through said upper string opening and then through said saddle plate string opening wherein said string is strung on an instrument.

4. The improved sustain block for stringed instruments according to claim 1 wherein said curved string path channel is open from said bottom opening to at least half of the length of said sustain block portion forming a u-shaped channel on the open portion therein.

5. The improved sustain block for stringed instruments according to claim 1 further comprising a plurality of mounting holes disposed through said sustain block and said saddle plate wherein said improved sustain block is secured to an instrument.

6. The improved sustain block for stringed instruments according to claim 1 further comprising a plurality of mounting holes disposed through said saddle plate wherein said improved sustain block is secured to an instrument.

7. The improved sustain block for stringed instruments according to claim 2 wherein said sustain block portion and said saddle plate are formed from a single piece.

8. The improved sustain block for stringed instruments according to claim 1 wherein said curved string path channel is selected to be parabolic in shape.

9. The improved sustain block for stringed instruments according to claim 1 wherein said curved string path channel is selected to have a radius of curvature selected to maximize a contact area.

10. An improved sustain block for stringed instruments comprises:

a sustain block portion;

said sustain block portion having a plurality of curved string paths disposed within;

said plurality of curved string paths having a string ball end nest disposed at a bottom portion of said sustain block portion and a plurality of string openings along a top portion therein;

said plurality of curved string paths having a curve arc selected to maximize contact between a string and said curved string path when said string is tensioned therein;

a saddle plate;

said saddle plate moveably holding a plurality of adjustable saddles therein;

a plurality of first string openings disposed on a top portion of said sustain block;

a plurality of second string openings in said saddle plate coinciding with said plurality first string opening; and said plurality of curved string paths disposed between said plurality of first and second string openings.

11. An improved sustain block for stringed instruments comprising:

a sustain block;

said sustain block being adapted to have at least one string path therein;

said string path comprising;

a bottom opening having a string ball end nest disposed therein;

a top opening;

a bore portion contiguous and below said top opening;

a channel portion contiguously disposed between said bottom opening and said bore portion wherein a musical instrument string fits within said string path and is anchored by wedging in said string ball end nest; and said string path defining a geometric shape maximizing contact between said musical instrument string and said sustain block whereby the musical qualities of said musical instrument string are transferred more effectively when said musical instrument string is vibrating.

* * * * *